United States Patent [19]

Brickley

[11] 3,999,244

[45] Dec. 28, 1976

[54] SHAG RUG RAKE

[75] Inventor: Alfred H. Brickley, Denver, Colo.

[73] Assignee: Century Tool Company, Denver, Colo.

[22] Filed: May 22, 1975

[21] Appl. No.: 579,951

[52] U.S. Cl. ..... 15/142; 15/402

[51] Int. Cl.[2] ..... A47L 13/00

[58] Field of Search ..... 15/142, 402

[56] References Cited

UNITED STATES PATENTS

| | | | |
|---|---|---|---|
| 1,008,382 | 11/1911 | Sourek | 15/142 X |
| 1,307,702 | 6/1919 | Rogers et al. | 15/142 X |
| 3,624,855 | 12/1971 | Shaw | 15/142 X |
| 3,740,788 | 6/1973 | Kingston | 15/142 |
| 3,744,082 | 7/1973 | Marshall | 15/402 |
| 3,828,386 | 8/1974 | Roth | 15/142 X |

*Primary Examiner*—Christopher K. Moore

*Attorney, Agent, or Firm*—James E. Pittenger

[57] ABSTRACT

A rake for raising and combing the pile of a rug, carpet or the like having a head and an elongated handle attached thereto. The head has a plurality of prongs arranged along an edge opposite said handle in at least two spaced, parallel rows with the individual prongs for each row arranged in alternating fashion. The head of the rake and the prongs are formed in a unitary, one-piece molded construction. The cantilever, double row arrangement of the prongs allows the downward force of the prongs to be essentially equal with the first row of prongs providing a raising effect on the pile with the following row combing the pile. The cross-section of the prongs is curved in a convexo-concave configuration which blends into the head to provide reinforcing and additional strength in the prongs.

6 Claims, 5 Drawing Figures

SHAG RUG RAKE

BACKGROUND OF THE INVENTION

The present invention is directed to a shag rug rake having a double row of flexible prongs. This invention is more specifically directed to a double row pronged rake having a unitary head with the prongs formed along one edge. The long and short prongs forming the double rows are arranged in alternating fashion so as to raise and straighten the pile on a shag rug, carpet, or the like.

As is well known, the pile of rugs or carpets which is more than a quarter or half an inch in length has a tendency to mat and lay down. Although part of this matting characteristic is attributable to the material of the carpet, the length of the pile is a substantial factor in the matting characteristic with the longer pile resulting in the greatest matting. Shag rugs notoriously have this shortcoming and after a substantial amount of traffic a pathway is defined in the carpet due to the pile laying down and being compressed.

In the past, various rakes have been provided for pulling over the traffic area in the reverse direction from the matting so that the pile can be straightened and raised to eliminate the matted area. These rakes, which are generally similar to the garden variety, have been provided for indoor use with various decorations and modifications in appearance. The major changes have been substantially cosmetic to provide a pleasing effect when the rake is stored or used in the home. In many of these devices the teeth or prongs of the rake are rigid which cause the prongs to snag and pull the pile of the rug or carpet.

The present invention is directed to a new and novel rake which includes a unitary, one piece head formed with flexible prongs extending from the outer edge. These prongs are arranged in two rows with the prongs of each row alternating. A suitable bracket is provided on one side of the head for the joining of a thin elongated handle to facilitate use of the rake and to reinforce the head by means of a short section of the handle. The prongs or teeth of the rake are arranged to extend outwardly parallel to the handle contrary to the fan arrangement which is common on many rakes.

A novel result of the rake according to the present invention is achieved through a combination of the flexibility obtained in the reinforced, elongated prongs and the double row arrangement provided.

In use, the handle of the rake is held at an angle of approximately 45° from the carpet surface. In this way, the outermost row of prongs contacts the carpet and is bent upward with relation to the head thus maintaining the prongs in substantial contact with the carpet surface with the force applied by the tip of the prongs determined by the degree of bend in the shank portion of the prong. The second or innermost row of prongs has a relatively shorter shank which is proportionately stiffer or less flexible. When the tip of the second row of prongs contacts the surface of the carpet the shorter shank bends only slightly. Thus, the downward force provided at the tip of each prong irrespective of whether the prong is in the furtherest or innermost row, is substantially equal.

To provide additional strength for the prongs, the cross section of the prongs is formed in a generally convexo-concave arrangement to provide additional strength during flexure. This configuration is provided throughout the entire length of the prong and is carried into the head of the rake a substantial distance to provide additional strength in the transition area.

An object of the present invention is to provide a rake for shag rugs and carpets in which the prongs of the rake provide an essentially consistent downward force on the carpet across the entire face of the rake.

A further object is to provide a rake in which several rows of prongs are provided with the prongs arranged in alternating fashion so that the pile of the carpet or rug is more efficiently raised and combed.

A still further object of the present invention is to provide a shag rug rake which is simple in design and inexpensive to manufacture.

A still further object of the present invention is to provide a shag rug rake which is lightweight yet has a one piece unitary construction with the prongs reinforced to provide additional strength to reduce breakage.

BRIEF DESCRIPTION OF DRAWINGS

Other features of this invention will appear in the following description and appended claims, reference being made to the accompanying drawings forming a part of the specification wherein like reference characters designate corresponding parts in the several views.

DESCRIPTION OF SPECIFIC EMBODIMENT

Figure 1:
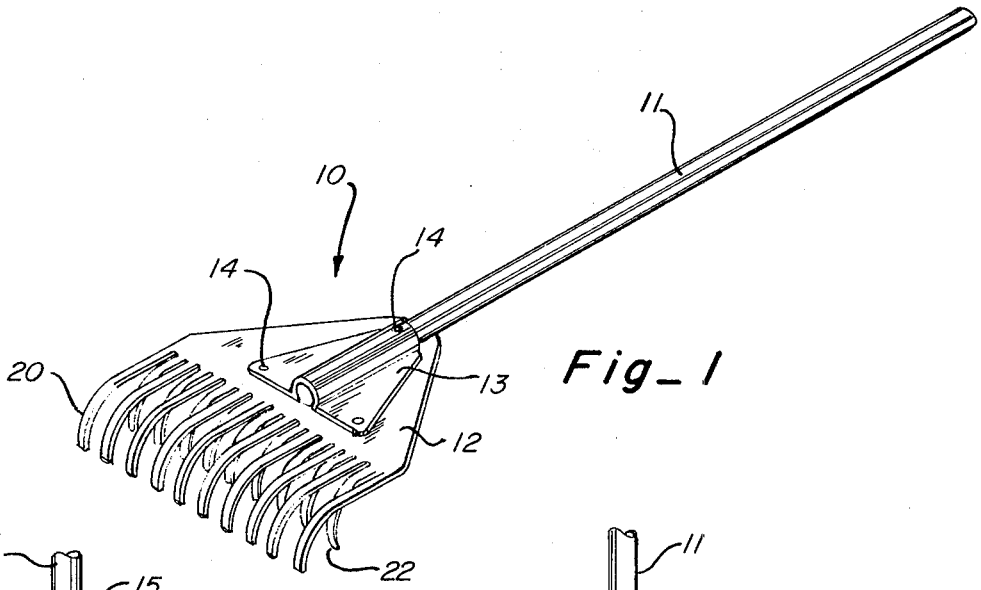
FIG. 1 is a diagrammatic perspective view of the shag rug rake according to the present invention.

As illustrated in FIG. 1, the shag rug rake 10 according to the present invention includes a thin elongated handle 11 securely attached to the head of the rake 12 by means of a bracket 13 forming a socket for the handle 11. Fastening devices 14 such as bolts or rivets are arranged to secure the bracket 13 to the head of the rake 12 and the handle 11.

Figure 2:
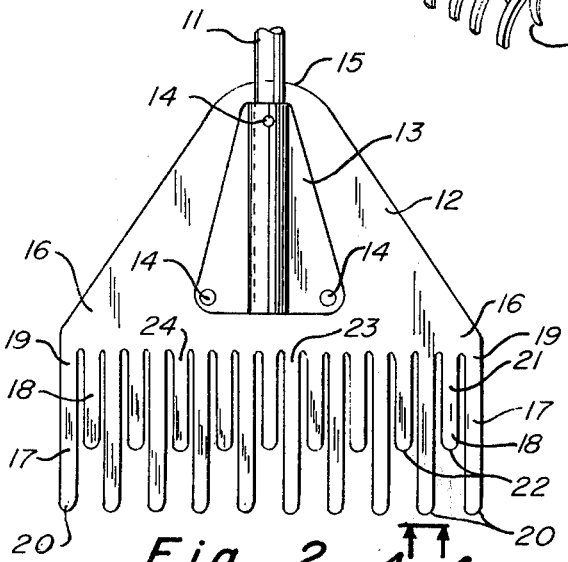
FIG. 2 is a top plan view of the head of the rake showing the prongs arranged in alternating fashion.
Figure 3:
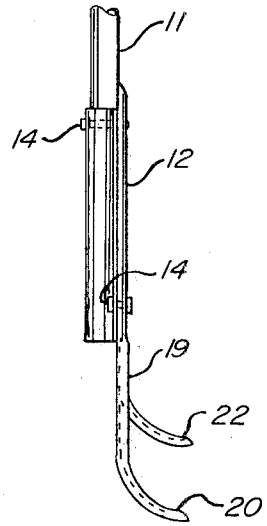
FIG. 3 is a side elevation view of the head of the rake showing the double row arrangement of the prongs.
Figure 4:
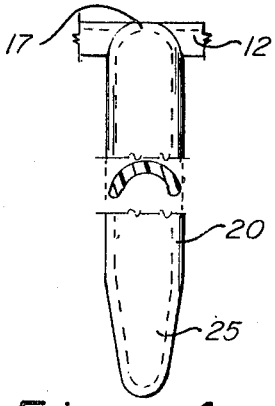
FIG. 4 is an end view of one of the outermost prongs showing the hollow, convex cross-section and the taper of the prong at its tip.

The rake head 12 tapers substantially in both directions from the handle end 15 to the edge 16 which is substantially perpendicular to the axis of the handle 11. The prongs 17, 18 extend outwardly from the edge 16 and are substantially parallel to the axis of the handle 11. The prongs 17 have a shank portion 19 and a tip portion 20 arranged so the tip is bent downwardly at approximately 90° from the shank 19. The prongs 18 have a substantially shorter shank portion 21 and a tip portion 22 also bent substantially 90° from the shank. The radius of curvature of the prongs 17 and 18 are substantially the same with the length of the shanks arranged so that the tip portions 20, 22 are formed into two rows. The prongs themselves are arranged in alternating fashion as shown in FIG. 2. The spacing between the individual prongs is substantially narrow and even so that the prong tips when pulled along the carpet follow paths which are substantially adjacent to each other. The prongs 17, 18 are formed in a substantially convexo-concave cross-section to provide additional reinforcement and strength along the sides and especially in the root area 23, 24 respectively. This convexo-concave configuration can be blended a considerable distance into the head 12 to provide continuity and strength in the root area 23, 24, where weakness is usually found. The width of the prongs 17, 18 at their tips 25 are tapered as shown in FIG. 4 to form a relatively narrow rounded end to better contact and lift the pile of the carpeting.

The head 12 of the shag rug rake 10 can be formed from any relatively high strength moldable or castable material such as metal, synthetic resins or plastics. It is intended that the head can be formed by simple injection molding or common lay-up methods using fiber glass reinforced materials. Although the strength of the material is important, the configuration of the head and prongs is provided to assist in reinforcing and strengthening the rake elements. The bracket 13 affixing the handle 11 to the head 12 can be either molded plastic or a separate easily formed metallic material such as steel or aluminum. Any type of thin elongated handle formed from a conventional material such as wood or metal can be used. It is possible that the moldable material from which the head 12 is made can have various dyes added so that the rake can have a variety of eye appealing colors to improve its salability.

In operation, the handle 11 of the rake 10 is designed so that depending upon the height of the user the handle will be positioned at an angle A which is generally within the range of 30° to 60°. It is anticipated that the nominal angle will be approximately 45° but any position within this range is believed to be acceptable. As pressure is applied to the handle 11 the tip portions 20, 22 of the prongs 17, 18 respectively, are pushed downward into the pile 26 of the carpet 27. The tip portions 20 of the prongs 17, which are in the outermost row, first contact the surface of the carpet 27. As additional pressure is applied to the handle 11 the shank 19 of the prongs 17 is forced to bend upward beyond the plane of the head 12. This bending coupled with the flexure strength of the prong material causes the tip 25 to exert a downward force on the carpet.

In like manner, as more pressure is applied to the handle the tip of the prongs 18 forming the inner row, contact the pile surface 26 of the carpet 27 causing the shank portion 21 to bend upward slightly. In this way a constant downward force is applied by the tips of the prongs which cause the tips to penetrate through the pile 26 to the backing of the carpet 27.

Figure 5:
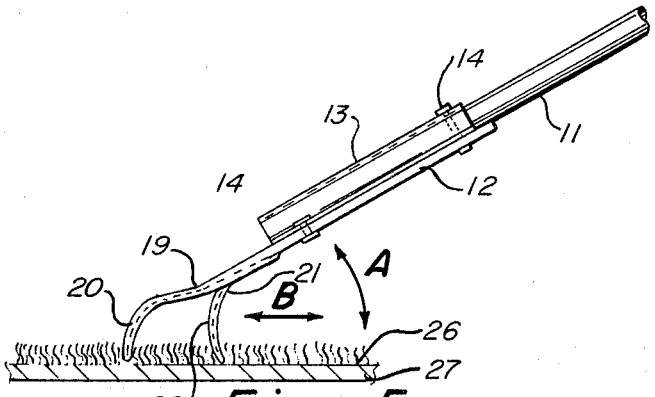
FIG. 5 shows a diagrammatic side view of the rake according to the present invention in use on a carpeted surface showing the shank of the prongs bending so as to apply even force on the prongs against the surface of the carpet.

As the rake 10 is moved backwards and forwards in the direction shown by arrow B in FIG. 5, the leading prong raises the pile 26 of the carpet 27 with the following prong substantially combing and straightening the pile. Thus, by moving the rake in a back and forth direction the pile is straightened, raked and combed to provide a pleasing appearance similar to a new condition.

Although the present invention is shown and described as being used for raking the pile on carpets and rugs, it is also to be understood to be capable of being used in other ways such as for removing grass clippings and leaves from yards or gardens. In any use, the flexure and application of even pressure by the prongs is provided to perform a uniform raking or straightening ability.

Having thus set forth and disclosed the nature of this invention, what is claimed is:

1. A rake for raising and combing the pile of rugs, carpets or the like comprising a. a thin, elongated handle, b. a relatively flat head means having an attaching means secured to one side for affixing said thin, elongated handle, and c. a plurality of prongs each having an elongated shank portion and a tip portion, the tip portion being disposed at an angle from one end of said shank portion and the opposite end of said shank portion being joined to an edge of said head means, the shank portion of all of the prongs being disposed in a common plane, d. said prongs being arranged in at least a first and a second group, the length of the shank portion of the prongs in each individual group being equal and the shank portion of the first group being longer than the shank portion of the second group, the prongs of the first and second group being arranged in alternating fashion with the longer prongs of the first group being positioned on the outer edges, the tips of said prongs forming at least two spaced, parallel rows whereby as said rake is moved across the surface of a rug, carpet or the like, a leading row of prong tips causes the pile to be raised with a trailing row of prong tips combing the pile to cause a neat, straightened appearance.

2. A rake as defined in claim 1 wherein, said head means and said prongs are formed as a one-piece, unitary member.

3. A rake as defined in claim 1 wherein said prongs are formed from a flexible material whereby the shank portion of the prongs are capable of bending when the tip portion is pushed against the surface of the rug, carpet or the like so that a relatively constant force is applied to the surface of the carpet by the tip portion of the prongs.

4. A rake as defined in claim 1 wherein the edge of said head means to which said prongs are attached is opposite to and substantially perpendicular to said handle.

5. A rake as defined in claim 1 wherein the angle between the tip and shank portion of each prong is approximately 90°.

6. A rake as defined in claim 1 wherein said prongs are formed from a flexible but flexurally strong material so that the prongs can bend when the tip portion is pushed against the surface of said carpet, rug or the like, and said prongs have a convexo-concave cross-section to add to the flexural strength of the prongs during this bending movement.

* * * * *